United States Patent [19]

Penven

[11] Patent Number: 5,053,109

[45] Date of Patent: Oct. 1, 1991

[54] SINGLE LAYER SEAMED PAPERMAKERS FABRIC

[75] Inventor: Patrick H. Penven, Clinton, S.C.

[73] Assignee: Asten Group, Inc., Charleston, S.C.

[21] Appl. No.: 190,037

[22] Filed: May 4, 1988

[51] Int. Cl.[5] ..... D03D 13/00; D21F 3/00

[52] U.S. Cl. ..... 162/348; 162/358; 162/DIG. 1; 139/383 A; 139/383 R; 139/425 A; 428/222; 428/234

[58] Field of Search ..... 162/DIG. 1, 358, 348; 428/234, 222; 139/383 A, 383 R, 425 A

[56] References Cited

U.S. PATENT DOCUMENTS

| | | | |
|---|---|---|---|
| 2,883,734 | 4/1959 | Draper, Jr. | 28/72 |
| 2,907,093 | 10/1959 | Draper, Jr. | 28/72 |
| 3,283,388 | 11/1966 | Kelleher et al. | 28/72 |
| 3,309,790 | 3/1967 | MacBean | 34/243 |
| 3,815,645 | 6/1974 | Codorniu | 139/383 A |
| 4,026,331 | 5/1977 | Lees et al. | 139/383 A |
| 4,123,022 | 10/1978 | Dutt et al. | 245/10 |
| 4,141,388 | 2/1979 | Romanski et al. | 139/383 A |
| 4,186,780 | 2/1980 | Josef et al. | 139/383 A |
| 4,364,421 | 12/1982 | Martin | 139/383 A |
| 4,401,137 | 8/1983 | Cannon | 139/383 A |
| 4,438,788 | 3/1984 | Harwood | 139/383 A |
| 4,439,481 | 3/1984 | Johnson et al. | 428/234 X |
| 4,500,590 | 2/1985 | Smith | 428/222 |
| 4,579,771 | 4/1986 | Finn et al. | 428/222 |
| 4,658,863 | 4/1987 | Errecart | 139/383 A |
| 4,683,624 | 8/1987 | Dufour | 28/141 |

FOREIGN PATENT DOCUMENTS 982682 2/1965 United Kingdom .

*Primary Examiner*—David A. Simmons
*Assistant Examiner*—Thi Dang
*Attorney, Agent, or Firm*—Volpe & Koenig

[57] ABSTRACT

An apparatus for manufacturing paper board includes a hybrid papermakers fabric which facilitates both the formation of an aqueous paper board web and the dewatering of the formed web through at least one press nip. The papermakers fabric includes a woven, single-layer base fabric having a seam with a layer of fibrous batt material needled to at least one side.

Each end of the base fabric has vertically oriented loops formed from the machine direction yarns of the base fabric. The base fabric seam is defined by intermeshing the respective end loops together and inserting a joining wire or pintle through the intermeshed loops. The caliper of the body of the single-layer base fabric is inherently slightly less than the caliper of the seam. In order to reduce the effect of the seam area on the paper board manufacturing process, the end loops of the base fabric may be elongated and may contain stuffer yarns.

21 Claims, 3 Drawing Sheets

SINGLE LAYER SEAMED PAPERMAKERS FABRIC

BACKGROUND OF THE INVENTION

This invention relates to papermaking and more particularly to fabrics for use on a paper board papermaking machine.

Generally a papermaking machine comprises a forming section, a press section and a dryer section. Papermakers fabrics transport an aqueous paper web through the machine to produce the paper product. Each of the three sections of the papermaking machine has its own unique characteristics and requirements. Accordingly, papermakers fabrics are specifically designed for each section of the papermaking machine such as forming fabrics for the forming section, wet press felts for the press section and dryer fabrics for the dryer section.

In operation, an aqueous paper web is formed on a forming fabric as the fabric passes through a slurry of wood pulp the like and over suction boxes. The suction boxes remove water to impart a degree of structural integrity to the web. The web is then transferred from the forming fabric to wet press felts for transportation through the pressing section of the papermaking machine. Thereafter, the pressed paper web is transferred to dryer fabrics for transportation through the dryer section of the papermaking machine.

Some relatively specialized papermaking equipment, such as paper board making equipment, have hybrid sections where a single fabric is required for both forming and some of the pressing operations. In such machines, the fabrics must not only have the capacity to uniformly form the aqueous base material into a paper board web, but also must be able to transport the web through the nip of press rollers.

In the pressing operation, the aqueous paper board web, due to its high moisture content, is highly susceptible to marking if the transporting surface of the fabric is not completely uniform in its characteristics. Additionally, uniform permeability of the fabric is important to assure the uniform formation of the web as well as to provide for the uniform dewatering of the web as it passes over suction cylinders and through press nips.

One conventional way of achieving uniformity of the fabric is to weave the fabric endless. However, such fabrics tend to be more difficult to install on papermaking equipment and the equipment must be specifically designed structurally to be able to accept an endless fabric.

Alternatively, a seam may be incorporated into the fabric which enables one end of the fabric to be threaded through the machine and joined with its opposing end in site which can greatly facilitate installation of the fabric on the machine. However, the seam area must have substantially the same characteristics as the remainder of the fabric to assure uniform formation and to avoid marking of the paper board web.

Fabrics comprising a base fabric made from monofilament synthetic yarns having a fibrous batt needled thereto have been designed for use with paper board papermaking equipment. However, in order to maintain a uniform caliper throughout both the body and the seam area of the fabric, base fabrics of such seamed fabrics have been comprised of multiple layers of monofilament yarns.

Multi-layer fabrics can be constructed with intermeshing end loops which are equal to or within the top and bottom base fabric layers such as disclosed in U.S. Pat. No. 3,815,645. However, multi-ply base fabrics become problematic when trying to achieve the desired weight and permeability requirements using a multi-ply base fabric.

It is desirous to provide papermakers fabric having a single-layer seamed base fabric to facilitate the forming and pressing operations in the manufacture of paper board.

OBJECTS AND SUMMARY OF THE INVENTION

It is the object of the invention to provide a papermakers fabric for use in papermaking equipment for both forming and transporting the formed paper web through the nip of press rollers and to specifically provide a single layer seamed fabric having a single-layer, woven base fabric for such purposes.

An apparatus for manufacturing paper board having a series of forming vats and associated suction dewatering devices facilitate the formation of an aqueous paper board web is disclosed. The apparatus includes at least one press nip for dewatering the formed web. A papermakers fabric is provided which traverses the forming vats to form the web and to also transport the web through the press nip. The papermakers fabric comprises a woven, single-layer base fabric having a seam. The base fabric is woven using monofilament synthetic yarns in a single layer having a system of yarns interweaving in a repeat pattern. Preferably the base fabric has a substantially uniform open area of 14% to 25% and a substantially uniform weight of 1.2 to 1.6 ounces per square foot.

At each end of the base fabric, the machine direction yarns form loops having a vertical orientation defining series of loops across said base fabric in the cross machine direction. The base fabric seam is defined by intermeshing the respective end's series of loops together and inserting a joining wire or pintle through the intermeshed loops.

Fibrous batt material is needled to at least one side of the base fabric such that the papermakers fabric preferably has a substantially uniform permeability of between 80 and 110 CFM and has a substantially uniform weight of between 2.8 to 3.6 ounces per square foot.

The caliper of the body of the single-layer base fabric is inherently slightly less than the caliper of the seam. In order to reduce the effect of the seam area on the paper board manufacturing process, the end loops of the base fabric are elongated and may contain stuffer yarns as set forth more fully below.

DETAILED DESCRIPTION OF THE PREFERRED EMBODIMENT

Figure 1:
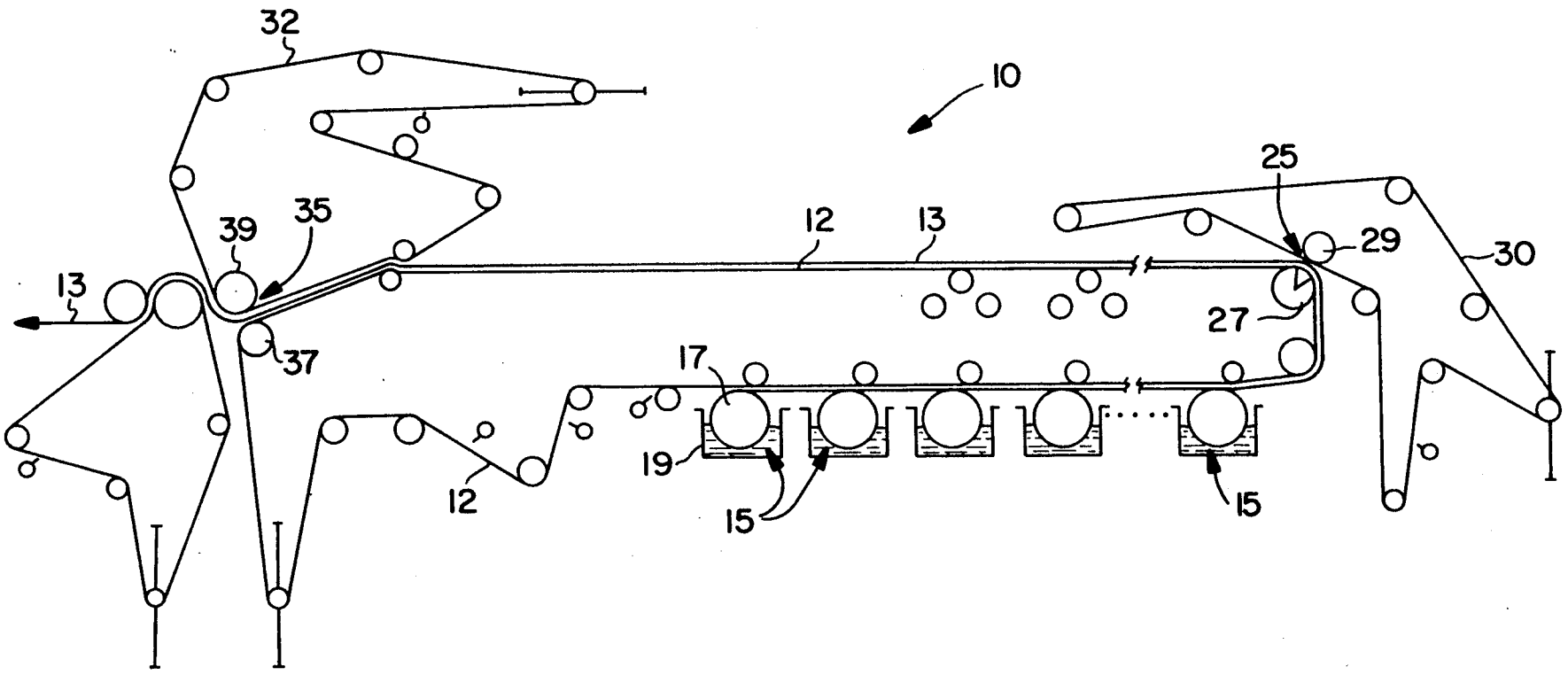
FIG. 1 is a schematic diagram of the forming and press sections of a papermaking machine used for making paper board.

Referring to FIG. 1, there is shown schematically part of a papermaking machine 10 for the manufacture of paper board. The papermaking machine includes a hybrid forming and press fabric 12 for forming and transporting the paper board web 13 on the machine 10. The fabric 12 travels across a series of forming vats 15. Each vat has an associated cylinder 17 over which the fabric 12 travels.

The vats contain a slurry material 19 from the which the paper board is formed. At the first vat, a first layer of the slurry material is picked up by the fabric 12 from the cylinder 17. As the fabric 12 travels across the remainder of the series of vats 15, a uniform layer of forming material 19 is deposited upon the previous layer until the desired paper web 13 is formed. After formation has been completed the web travels through a press nip 25 between press rollers 27 and 29.

The hybrid fabric 12 carries the paper board web 13 through the nip 25. A press felt 30 assists in the dewatering process running on the opposite side of the web 13 as it is carried through the nip 25. Subsequently, the paper web is transferred to a second press felt 32 from the hybrid fabric 12 as the web passes through nip 35 formed by press rollers 37 and 39. Thereafter the web travels through additional pressing and drying operations on other fabrics to complete the paper board manufacturing process. For clarity, in FIG. 1, web 13 is illustrated slightly apart from the papermakers fabrics 12, 30, 32; in actual operation it will be recognized that the web 13 is contiguous with the respective papermakers fabrics as it is transported in the machine 10 and through the nips.

Generally, as more water is removed from the web the tendency to mark is reduced. While the paper board web is being formed and is traveling through the initial pressing operations, it is highly susceptible to marking.

Figure 2:
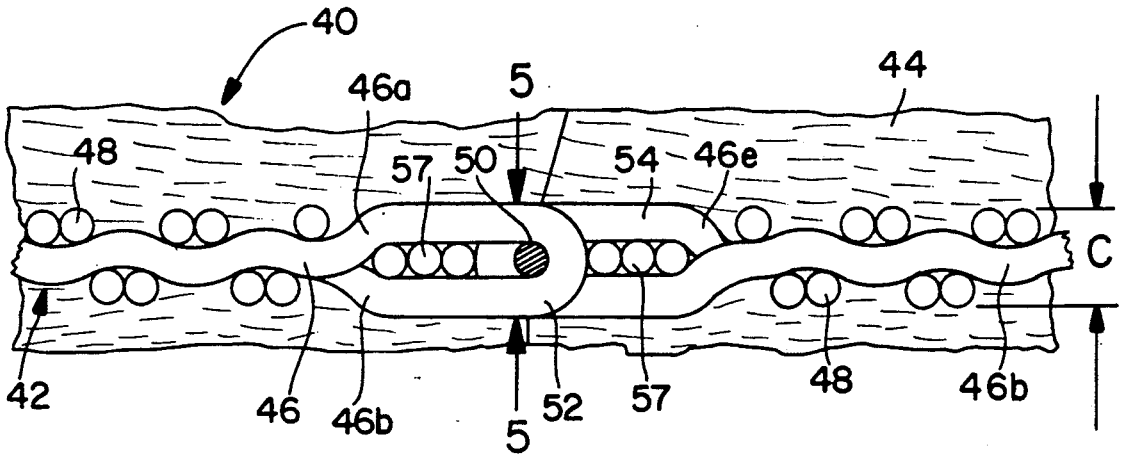
FIG. 2 is a cross section, in the machine direction, of the seam area of a papermakers fabric for use in forming and transporting the paper board web made in accordance with the present invention.

Referring to FIG. 2, there is shown a papermakers fabric which, through testing, has proven to be able to form the paperboard web and transport the web through the initial pressing phases of the paper board making process. The fabric 40 comprises a base fabric 42 and fibrous batt material 44 attached thereto through a conventional needling process.

The base fabric is woven from monofilament, synthetic yarns. The yarns are preferably nylon, but may be polyester, or any other suitable synthetic material. A single layer of machine direction ("MD") yarns 46 are interwoven with a system of cross machine direction ("CMD") yarns 48.

Figure 3:
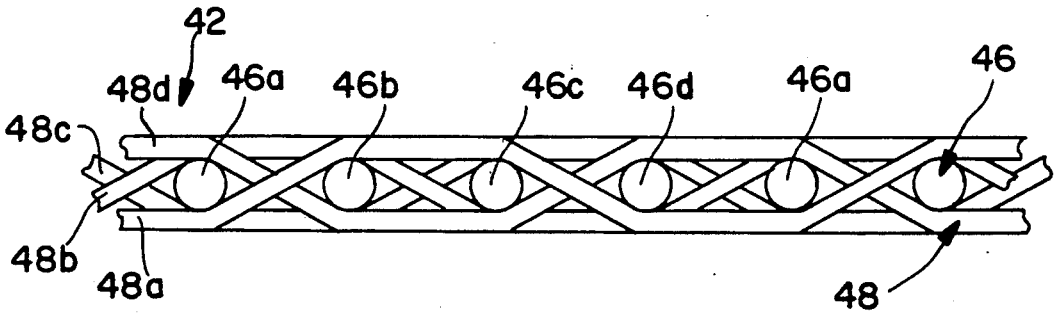
FIG. 3 is a cross section in the cross machine direction of the single layer base fabric of the papermakers fabric shown in FIG. 2.

As best seen in FIG. 3, the CMD yarns 48 interweave with the MD layer of yarns in a repeat pattern with CMD floats which extend over two (2) MD yarns and then under two (2) MD yarns. For example, CMD yarn 48*a* weaves between MD yarns 46*a*, 46*b*, over MD yarns 46*b* and 46*c*, between MD yarns 46*c*, 46*d* and under MD yarns 46*d*, 46*a*, thereafter repeating in similar fashion. CMD yarn 48*b* weaves over MD yarns 46*a*, 46*b*, between MD yarns 46*b*, 46*c*, under MD yarns 46*c*, 46*d*, and between MD yarns 46*d*, 46*a* thereafter repeating in similar matter. CMD yarns 48*c* weaves under MD yarns 46*a*, 46*b*, between MD yarns 46*a*, 46*b*, between MD yarns 46*a*, 46*b*, between MD yarns 46*b*, 46*c*, over MD yarns 46*c*, 46*d* and between MD yarns 46*d*, 46*a* thereafter repeating. CMD 48*d* weaves between MD yarns 46*a*, 46*b*, under MD yarns 46*b*, 46*c*, between MD yarns 46*c*, 46*d*, and over MD yarns 46*d*, 46*a*, thereafter repeating.

Figure 4:
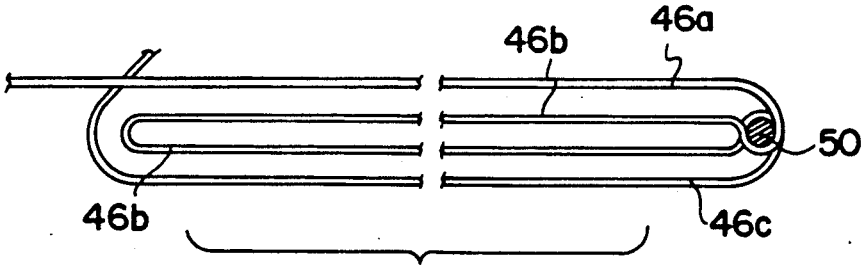
FIG. 4 is a schematic diagram of the endless weaving of the machine direction yarns of the base fabric shown in FIGS. 2 and 3.

With reference to FIG. 4, the base fabric 42 is woven on an endless loom such that the layer of MD yarn 16 is woven as the loom weft yarn. The MD yarn weaving as yarn 46*a* across the loom looping around joining wire 50 forming a loop 52 returning across the loom as yarn 46*b*. Yarn 46*b* then travels back across the loom looping around joining wire 50 in the other direction forming a loop 54, and returning as yarn 46*c*. Such endless weaving techniques are generally known in the art as exemplified by U.S. Pat. No. 3,815,645. Unlike the fabrics disclosed in that patent, the weft of the present fabric is woven as a single layer within the base fabric.

In the preferred embodiment, the hybrid fabric has a uniform weight from 2.8 to 3.6 ounces per square foot, preferably 3.2 ounces per square foot, and a uniform permeability of between 80 and 110 CFM as measured on a Frazier air permeability tester. The weight and permeability of the fabric are very important to the fabric's utility in forming and pressing of the paper board web 13. In one example, the preferred weight and permeability of the fabric is achieved by weaving the base fabric using 19 mil yarns in the machine direction and 15 mil yarns in the cross machine directions such that the base fabric has 16 loops per inch MD yarns and 30 CMD yarns per inch. The resultant base fabric has a weight of approximately 1.45 ounces per square foot and 21% open area. Thereafter, fibrous batt material weighing about 1.75 ounces per square foot is needled onto the base fabric; the resultant fabric has the desired weight and permeability.

Referring to FIG. 2, it will be recognized by one of ordinary skill in the art that the caliper C of the single-ply base fabric 42 is somewhat less than the diameter of two CMD yarns 48 plus one MD yarn 46. This is due to the inherent crimp of the CMD yarns 48 in weaving with the MD yarns 46, particularly where the base fabric has sufficient open area to meet the permeability requirements discussed above. However, in the seam area, the caliper S of the single-ply base fabric will be at least the diameter of two MD yarns plus the diameter of the pintle yarn 50. Accordingly, the seam area tends to be of a greater caliper than the body of the fabric. This is not the case with multi-ply base fabrics such as disclosed in U.S. Pat. No. 3,815,645 which maintain the joining loops within the plane of the top and bottom layers of a multi-ply base fabric.

In order to minimize the effect of the non-uniformity of the seam area of the fabric, the loops 52, 54 which are formed at the respective ends of the base fabric are made elongated in the finished fabric. This is accomplished by looping the CMD yarns around one or more stuffer yarns as the fabric is being woven or insertion before needling. For example, MD yarn 46*a* passes over three (3) stuffers 57 and joining wire 50 forming loop 52 as it returns as MD yarn 46*b*; similarly MD yarn 46*b* in forming loop 54 passes under three (3) stuffer yarns 57 as it loops around joining wire 50 to create loop 54 returning as MD yarn 46c. The stuffer yarns 57, like the joining wire 50 do not interweave.

Alternatively, an oversized wire or mandrel may be used in place of joining wire 50 when the base fabric is woven. The mandrel is thereafter replaced with the smaller diameter joining wire 50 and stuffers are packed into the respective series of end loops outside of the intermeshing channel occupied by the joining wire 50.

After base fabric 42 has been formed, it is heat set and tensioned such that the loops 52, 54 are fully elongated and the maximum vertical dimension of the loops S is defined where the loop wraps around the joining wire 50. Although the caliper S of the seam area of the base fabric is slightly greater than the caliper C of the remainder of the base fabric, the elongated loops contribute to a gradual caliper transition which minimizes the effect of the seam area on the paper board web as the paper board is being manufactured.

The fibrous batt material 44 is needled to the base fabric 42 in its tensioned condition. The needling maintains both the stuffers 57 and the loops 52,54 in their position. After the fibrous batt has been uniformly applied over the entire base fabric, the batt material is cut along the seam and the joining wire is removed to separate the respective ends of the finished fabric. Thereafter, the fabric is installed onto the paper board making equipment in its open condition and the two ends are joined in situ by intermeshing the loops 52, 54 and reinserting joining wire or pintle yarn through the intermeshed loops.

In order to assure uniform permeability of the seam area with the remainder of the fabric, a soluble yarn may be used as one or more of the stuffer yarns 57. If soluble yarns are employed, they are dissolved from the fabric after the batting material has been needled to securely lock the loops in position. A further detailed explanation of the elongated loop seam and the use of soluble stuffers therein is set forth in my co-pending U.S. patent application Ser. No. 190,135 and Ser. No. 190,030, both entitled "Seam Design For Seamed Felts" filed on even date herewith which is incorporated by reference as if fully set forth.

Figure 5:
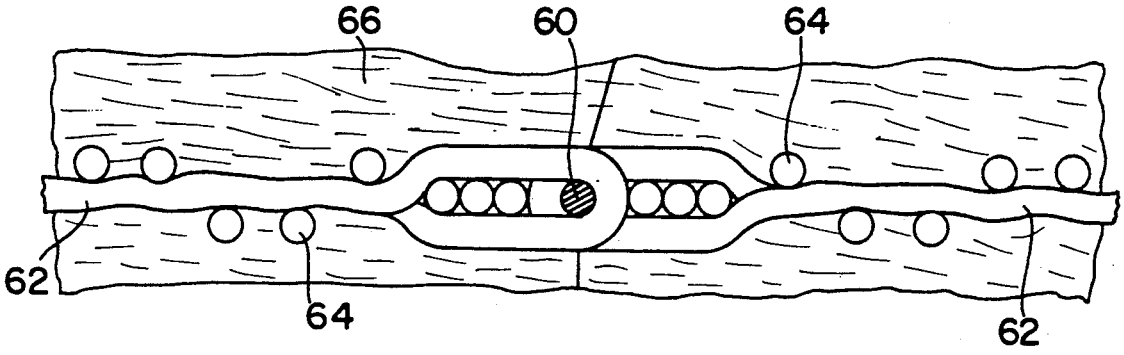
FIG. 5 is a cross section in the machine direction of the seam area of an alternate embodiment of a fabric made in accordance with the teachings of the present invention.
Figure 6:
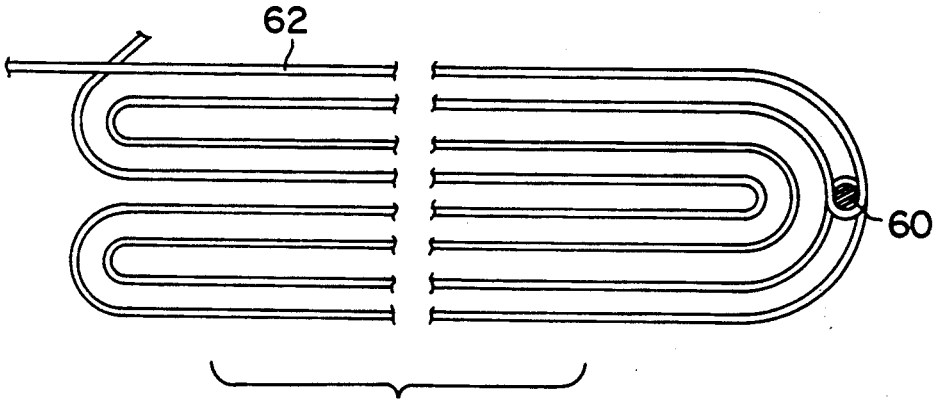
FIG. 6 is a schematic diagram of the endless weave of the machine direction yarns of the base fabric of the papermakers fabric depicted in FIG. 5.

FIG. 5 shows an alternate embodiment of a papermakers fabric made in accordance with the teachings of the present invention. As illustrated in FIG. 6, the fabric is woven double endless whereby the machine direction yarn loops are formed around joining wire 60 every other time the weft yarn completes its back and forth traverse on the loom.

In this embodiment, the machine direction yarns 62 are preferably 19 mils in diameter and woven 16 loops per inch; the cross machine direction yarns 64 are preferably 15 mils in diameter and are woven at 15 CMD yarns per inch. This results in a base fabric having a weight of approximately 1.2 ounces per square foot and an open area of approximately 25%. Thereafter, batt material 66 having a weight of approximately 2 ounces per square foot is needled to the base fabric thereby providing a desired weight of 3.2 ounces per square foot and permeability of between 80 and 110 CFM as set forth above.

Figure 7:
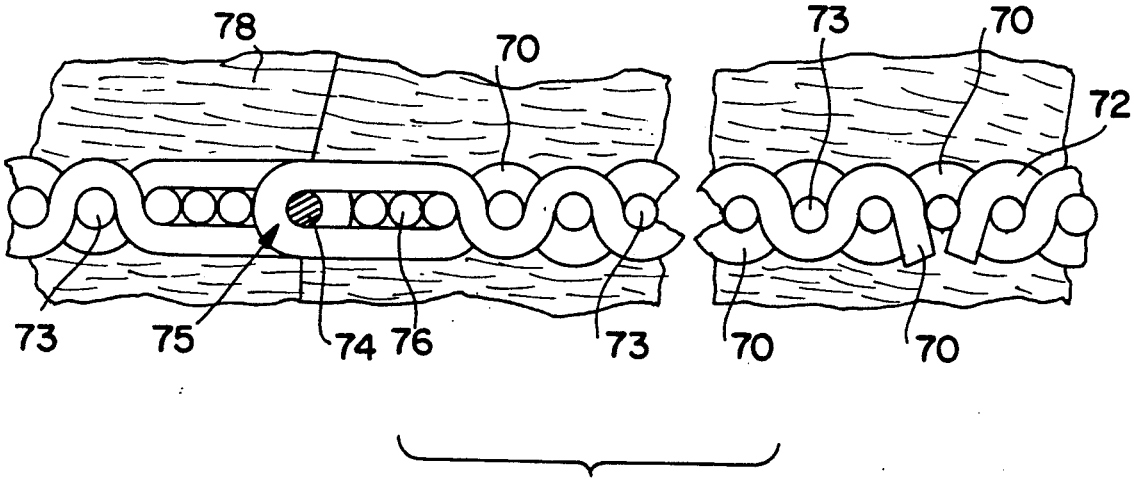
FIG. 7 is a cross section in the machine direction of the seam area of a second alternate embodiment of a fabric made in accordance with the teachings of the present invention.

FIG. 7 shows a second alternate embodiment of papermakers fabric made in accordance with the teachings of the present invention. Instead of weaving the base fabric endless (or double endless), the base fabric is woven flat to a desired length such that the machine direction yarns 70, 72 are woven as warp yarns and the cross machine direction yarns are woven as the weft or filling yarns. The end loops 75 of the fabric are formed by backweaving the MD yarns. For example, adjacent MD yarns 70, 72 are woven as warp in the fabric. MD yarn 72 is cut a number of CMD yarns 73 from the end of the fabric and the cut portion is removed. Thereafter MD yarn 70 is looped back and interwoven with the CMD yarns 73 in the space vacated by the cut portion adjacent MD yarn 72. The distance the yarn 70 is backwoven from the fabric may vary in accordance with the weave pattern and amount of crimpt, but is sufficiently far enough to prevent the loop from pulling out when the fabric is tensioned and heat set for the application of fibrous batt material 78.

Preferably, 19 mil synthetic monofilament yarns are used in both the machine and cross machine direction. The MD yarns are preferably woven 21 loops per inch and the CMD yarns woven 15 per inch resulting in a base fabric weighing approximately 1.6 ounces per square foot having an open area of approximately 14%. After the loops are formed, the base fabric ends are joined together by intermeshing the loops and inserting a pintle 74 therethrough. Stuffer yarns 76 can be inserted either during the formation of the loops or after the loops have been formed and joined together with the pintle 74.

The fabric is then heat set and tensioned such that the loops are fully elongated as discussed above. Thereafter fibrous batt material 78 weighing approximately 1.6 ounces per square foot is needled onto the fabric to provide the fabric with the desired weight and permeability characteristics for use on the paper board making apparatus. The needling of the fibrous batt material 78 onto the fabric also assists in locking the backwoven portions of the MD yarns in position to inhibit displacement of the MD yarns and disruption of the seam area as the fabric is used to make paper board.

What I claim is:

1. An apparatus for manufacturing paper board having a series of forming vat means and associated suction dewatering means to facilitate the formation of an aqueous paper board web, at least one press nip for dewatering the formed web, and a papermakers fabric which traverses said vat means to form the web and transports the web through said press nip, wherein the papermakers fabric comprises:

(a) a woven, single-layer base fabric having first and second ends joined together in a seam;

(b) said base fabric including a single layer of machine direction yarns having a system of cross machine direction yarns interwoven with said machine direction yarns in a repeat pattern such that said base fabric has a substantially uniform open area and a substantially uniform weight;

(c) at each end of said base fabric, said machine direction yarns formed into loops having a vertical orientation defining series of loops across said base fabric in the cross machine direction;

(d) said base fabric seam defined by said first end series of loops intermeshed with said second end series of loops having a joining pintle inserted through the intermeshed loops;

(e) the greatest vertical dimension of said loops being proximate said joining pintle and greater than the caliper of the body of the base fabric;

(f) at least one of the series of said loops being elongated to accommodate the thickness of at least the pintle, a stuffer yarn and one machine direction yarn therein;

(g) said elongated series of loops having at least one stuffer yarn disposed therethrough outside the intermeshing loop area; and (h) a layer of fibrous batt material needled to at least one side of said base fabric.

2. An apparatus according to claim 1 wherein:

(a) both of the series of said loops are elongated to accommodate the thickness of at least the pintle, a stuffer yarn and one machine direction yarn therein; and (b) each elongated series of loops has at least one stuffer yarn disposed therethrough outside the intermeshing loop area.

3. An apparatus according to claim 2 wherein the pintle and stuffer yarns are the same thickness as the cross machine direction yarns.

4. An apparatus according to claim 1 wherein said papermakers fabric is woven endless such that said machine direction yarns are substantially a continuous length of yarn throughout the fabric.

5. An apparatus according to claim 4 wherein said cross machine direction yarns interweave with said machine direction yarns in a repeat pattern having floats under at least two machine direction yarns and over at least two machine yarns.

6. A papermaker's fabric according to claim 5 wherein the pintle add stuffer yarns are the same thickness as the cross machine direction yarns.

7. An apparatus according to claim 1 wherein said base fabric has a substantially uniform weight of 1.2 to 1.6 ounces per square foot and said papermakers fabric has a substantially uniform weight of approximately 3.2 ounces per square foot.

8. An apparatus according to claim 1 wherein said base fabric has a substantially uniform open area of between 1.4% and 2.5% and said papermakers fabric has a substantially uniform permeability of between 80 and 110 CFM.

9. An apparatus for manufacturing paper board having a series of vat means and associated suction dewatering means to facilitate the formation of an aqueous paper board web, at least one press nip for dewatering the formed web, and a papermakers fabric which traverses said vat means to form the web and transports the web through said press nip, wherein the papermakers fabric comprises:

(a) a woven, single-layer base fabric having first and second ends joined together in a seam;

(b) said base fabric including a single layer of machine direction yarns having a system of cross machine direction yarns interwoven with said machine direction yarns in a repeat pattern such that said base fabric has a substantially uniform open area of 14% to 25% and a substantially uniform weight of 1.2 to 1.6 ounces per square foot;

(c) at each end of said base fabric, said machine direction yarns form loops having a vertical orientation defining series of loops across said base fabric in the cross machine direction;

(d) said base fabric seam defined by said first end series of loops are intermeshed with said second end series of loops and have a joining pintle inserted through the intermeshed loops, wherein:

the greatest vertical dimension of said loops is proximate said joining pintle and greater than the caliper of the body of said base fabric;

at least one of the series of said loops is elongated to accommodate the thickness of at least the pintle, a stuffer yarn and one machine direction yarn therein; and said elongated series of loops has at least one stuffer yarn disposed therethrough outside the intermeshing loop area; and (e) fibrous batt material needled to at least one side of said base fabric such that said papermakers fabric has a substantially uniform permeability of between 80 and 110 CFM and has a substantially uniform weight of 3.2 ounces per square foot.

10. An apparatus according to claim 9 wherein:

(a) both of the series of said loops are elongated to accommodate the thickness of at least the pintle, a stuffer yarn and one machine direction yarn therein; and (b) each elongated series of loops has at least one stuffer yarn disposed therethrough outside the intermeshing loop area.

11. An apparatus according to claim 10 wherein the pintle and stuffer yarns are the same thickness as the cross machine direction yarns.

12. A papermakers fabric comprising:

(a) a woven, single-layer base fabric having first and second ends;

(b) said base fabric including a single layer of machine direction yarns having a system of cross machine direction yarns interwoven with said machine direction yarns in a repeat pattern such that said base fabric has a substantially uniform open area and a substantially uniform weight;

(c) at each end of said base fabric, said machine direction yarns formed into loops having a vertical orientation defining series of loops across said base fabric in the cross machine direction such that said base fabric ends can be joined by intermeshing said first end series of loops with said second end series of loops and inserting a joining pintle through the intermeshed loops;

(d) the greatest vertical dimension of said loops being greater than the caliper of the body of the base fabric;

(e) at least one of the series of said loops being elongated to accommodate the thickness of at least a pintle yarn, a stuffer yarn and one machine direction yarn therein;

(f) said elongated series of loops having at least one stuffer yarn disposed therethrough proximate the respective endmost woven cross machine direction yarn of said systems of cross machine direction yarns, such that the interior of the loops project at least the diameter of a pintle yarn plus one machine direction yarn from said cross machine direction stuffer yarn; and (g) a layer of fibrous batt material needled to at least one side of said base fabric, wherein said cross machine direction stuffer yarn facilitates the maintenance of the vertical orientation of said loops during needling and said needled batt material maintains the position of said stuffers within said fabric.

13. A papermakers fabric according to claim 12 wherein said papermakers fabric is woven endless such that said machine direction yarns are substantially a continuous length of yarn throughout the fabric.

14. A papermakers fabric according to claim 13 wherein said cross machine direction yarns interweave with said machine direction yarns in a repeat pattern having floats under at least two machine direction yarns and over at least two machine direction yarns.

15. A papermakers fabric according to claim 12 wherein said base fabric has a substantially uniform weight of 11.2 to 1.6 ounces per square foot and said papermakers fabric has a substantially uniform weight of approximately 3.2 ounces per square foot.

16. A papermakers fabric according to claim 12 wherein said base fabric has a substantially uniform open area of between 1.4% and 2.5% and said papermakers fabric has a substantially uniform permeability of between 80 and 110 CFM.

17. A papermakers fabric according to claim 12 wherein said base fabric is flat woven such that said machine direction yarns are woven 21 loops per mil and the cross-machine direction yarns are woven 15 per inch.

18. A papermakers fabric comprising:

(a) a woven, single-layer base fabric having first and second ends;

(b) said base fabric including a single layer of machine direction yarns having a system of cross machine direction yarns interwoven with said machine direction yarns in a repeat pattern such that said base fabric has a substantially uniform open area of 14% to 25% and a substantially uniform weight of 1.2 to 1.6 ounces per square foot;

(c) at each end of said base fabric, said machine direction yarns form loops having a vertical orientatiion defining series of loops across said base fabric in the cross machine direction such that said base fabric ends can be joined by intermeshing said first end series of loops with said second end series of loops and inserting a joining pintle through the intermeshed loops, wherein:

the greatest vertical dimension of said loops is greater than the caliper of the body of the base fabric;

at least one of the series of said loops is elongated to accommodate the thickness of at least a pintle yarn, a stuffer yarn and one machine direction yarn therein; and said elongated series of loops has at least one stuffer yarn disposed therethrough proximate the respective endmost woven cross machine direction yarn of said system of cross machine direction yarns, such that the interior of the loops project at least the diameter of a pintle yarn plus one machine direction yarn from said stuffer yarn thereby permitting the joining of the two ends of said fabric together by intermeshing the end loop series and inserting a pintle yarn therethrough; and (d) fibrous batt material needled to at least one side of said base fabric such that said papermakers fabric has a substantially uniform permeability of between 80 and 110 CFM and has a substantially uniform weight of approximately 3.2 ounces per square foot.

19. A papermaker's fabric according to claim 18 wherein the pintle and stuffer yarns are the same thickness as the cross machine direction yarns.

20. A papermakers fabric comprising:

(a) a woven, single-layer base fabric having first and second ends;

(b) said base fabric including a single layer of machine direction yarns having a system of cross machine direction yarns interwoven with said machine direction yarns in a repeat pattern such that said base fabric has a substantially uniform open area of 14% to 25% and a substantially uniform weight of 1.2 to 1.6 ounces per square foot;

(c) at each end of said base fabric, said machine direction yarns form loops having a vertical orientation defining series of loops across said base fabric in the cross machine direction such that said base fabric ends can be joined by intermeshing said first end series of loops with said second end series of loops and inserting a joining pintle through the intermeshed loops, wherein:

both of the series of said loops are elongated to accommodate the thickness of at least a pintle yarn, a stuffer yarn and one machine direction yarn therein; and each elongated series of loops has at least one stuffer yarn disposed therethrough proximate the respective endmost woven cross machine direction yarn of said systems of cross machine direction yarns, such that the interior of the loops project at least the diameter of a pintle yarn plus one machine direction yarn from said cross machine direction stuffer yarn thereby permitting the joining of the two ends of said fabric together by intermeshing the end loop series and inserting a pintle yarn therethrough; and (d) fibrous batt material needled to at least one side of said base fabric such that said papermakers fabric has a substantially uniform permeability of between 80 and 110 CFM and has a substantially uniform weight of approximately 3.2 ounces per square foot.

21. A papermaker's fabric according to claim 20 wherein the pintle and stuffer yarns are the same thickness as the cross machine direction yarns.

* * * * *

UNITED STATES PATENT AND TRADEMARK OFFICE

CERTIFICATE OF CORRECTION

PATENT NO. : 5,053,109

DATED : October 1, 1991

INVENTOR(S) : Patrick H. Penven

It is certified that error appears in the above-indentified patent and that said Letters Patent is hereby corrected as shown below:

IN THE DRAWINGS

Figure 2, number "5" should be --S--.

reference numeral "46e" should be --46c--.

Column 1, line 21, after "pulp" insert --or--.

Column 4, line 15, delete number "16" and insert --46--.

Column 5, line 41, delete number " 190,135" and insert -- 190,136--.

Column 7, line 27, after "machine" insert --direction--.

Column 7, line 29, delete "add" and insert --and--.

Column 9, line 6, delete numeral "11.2" and insert --1.2--.

Column 9, line 32, delete "orientatiion" and insert --orientation--.

Signed and Sealed this

Fourth Day of October, 1994

*Attest:*

*Attesting Officer*

BRUCE LEHMAN

*Commissioner of Patents and Trademarks*